US006474620B2

(12) United States Patent
Cornell et al.

(10) Patent No.: US 6,474,620 B2
(45) Date of Patent: Nov. 5, 2002

(54) METHOD OF CONTROLLING HYDRAULICALLY ACTUATED VALVES AND ENGINE USING SAME

(75) Inventors: Sean O. Cornell, Gridley, IL (US); Scott A. Leman, Eureka, IL (US); David E. Martin, Normal, IL (US); Ronald D. Shinogle, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/745,058

(22) Filed: Dec. 20, 2000

(65) Prior Publication Data

US 2002/0074531 A1 Jun. 20, 2002

(51) Int. Cl.[7] ..... F16K 31/122
(52) U.S. Cl. ..... 251/48; 123/90.12
(58) Field of Search ..... 123/90.12; 251/48

(56) References Cited

U.S. PATENT DOCUMENTS

| | | | | |
|---|---|---|---|---|
| 4,162,689 A | * | 7/1979 | Zdrodowski | 137/624.12 |
| 4,572,114 A | | 2/1986 | Sickler | |
| 4,716,862 A | * | 1/1988 | Sauro | 123/90.12 |
| 5,167,292 A | * | 12/1992 | Moiroux et al. | 60/415 |
| 5,255,641 A | | 10/1993 | Schechter | |
| 5,531,192 A | | 7/1996 | Feucht et al. | |
| 5,619,965 A | | 4/1997 | Cosma et al. | |
| 5,636,602 A | | 6/1997 | Meister | |
| 5,890,459 A | * | 4/1999 | Hedrick et al. | 123/27 GE |
| 5,957,111 A | | 9/1999 | Rodier | |
| 5,996,558 A | * | 12/1999 | Ouellette et al. | 123/506 |
| 6,067,946 A | * | 5/2000 | Bunker et al. | 123/90.12 |

FOREIGN PATENT DOCUMENTS

| | | |
|---|---|---|
| DE | 3841997 A1 | 10/1974 |
| DE | 3500530 A1 | 7/1986 |
| EP | 0886037 A2 | 12/1998 |
| EP | 1054138 A2 | 11/2000 |
| GB | 2107393 A | 4/1983 |

OTHER PUBLICATIONS

SAE Technical Paper Series—Camless Engine, #960581, Michael M. Schechter and Michael B. Levin.

* cited by examiner

*Primary Examiner*—Henry C. Yuen
*Assistant Examiner*—John Bastianelli
(74) *Attorney, Agent, or Firm*—Liell & McNeil

(57) ABSTRACT

The present invention finds application in hydraulically actuated valves, such as gas exchange valves, having a valve member that moves within a valve body between an open position and a closed position. In valves such as these, the valve member typically includes a valve surface that contacts a valve seat included on the valve body when moving to its closed position. However, the impact velocity when the valve surface contacts the valve seat can be quite high. This can lead to fatigue of the valve stem and can wear out the valve seat, both of which can shorten the effective life of the valve. Therefore, the present invention includes a hydraulic pulse generator for slowing movement of the valve member which includes the direction of a hydraulic pulse toward the valve member as the valve member moves from its open position to its closed position.

17 Claims, 3 Drawing Sheets

METHOD OF CONTROLLING HYDRAULICALLY ACTUATED VALVES AND ENGINE USING SAME

TECHNICAL FIELD

This invention relates generally to a method of controlling hydraulically actuated valves, and more particularly to a method of reducing impact velocities for hydraulically actuated exhaust and intake valves of an engine.

BACKGROUND ART

In engines utilizing mechanically activated valves, such as gas exchange valves, a cam drives a valve member within the valve to move between a closed position and an open position. Thus, for a mechanically controlled exhaust valve, rotation of a cam moves the exhaust valve member from its closed position to its open position, and vice versa, at a speed corresponding to the cam profile and its rotation rate. In engines such as these, the impact velocity of the valve member closing a respective valve seat can be on the order of tens of centimeters per second. While these impact velocities are acceptable, there is a trend in industry to move away from cam actuation toward electronic control in order to control events independent of engine speed and crank angle.

In response to this trend, the use of hydraulically actuated electronically controlled gas exchange valves, such as exhaust and intake valves, has been on the rise. For instance, U.S. Pat. No. 5,255,641 issued to Schechter on Oct. 26, 1993, discloses an engine having hydraulically controlled intake and exhaust valves. In these valves, the impact velocity of the hydraulically actuated valve member closing its respective valve seat can be as much as an order of magnitude or more greater than that for a mechanically actuated valve member. High impact velocities, such as those produced in some hydraulically actuated valves, can fatigue the valve stem and wear out the seat area, which can lead to a reduction in the effective life of the gas exchange valve member and its respective valve seating surface.

One prior method of reducing impact velocities for hydraulically actuated gas exchange valve members included placing a flow restriction in the drain of the valve actuator. However, the presence of a flow restriction causes the velocity of the valve member to slow over the entire travel distance between its open position and its closed position. While this strategy can reduce the impact velocity, the valve closing event is lengthened, possibly to the point of interfering with other engine events. Therefore, a method of reducing the impact velocity that does not significantly lengthen the duration of the valve closing event would find particular application with hydraulically actuated gas exchange valves.

The present invention is directed to overcoming one or more of the problems as set forth above.

DISCLOSURE OF THE INVENTION

In one aspect of the present invention, an improvement for a hydraulically actuated valve having a valve member operably coupled to a hydraulic valve actuator includes a hydraulic pulse generator fluidly connected to the hydraulic valve actuator. The hydraulic pulse generator is capable of directing a hydraulic pulse toward the valve member as the valve member is moving from a first position toward a second position.

In another aspect of the present invention, an engine includes an electronic control module having a means for determining when a valve member of a hydraulically actuated valve is at a predetermined location between a first position and a second position. Also provided is a means for directing a hydraulic pulse toward the hydraulically actuated valve when the valve member is approaching the second position, wherein the magnitude of the hydraulic pulse is insufficient to reverse a movement direction of the valve member.

In yet another aspect of the present invention, a method of controlling hydraulically actuated valves includes providing a hydraulically controlled valve that has a valve member that is movably positioned in a valve body, wherein the valve member is movable between a first position and a second position and provides a hydraulic surface. Movement of the valve member toward the second position is slowed, at least in part by directing a hydraulic pulse toward the valve member when the valve member is moving toward the second position.

BEST MODE FOR CARRYING OUT THE INVENTION

Figure 1:
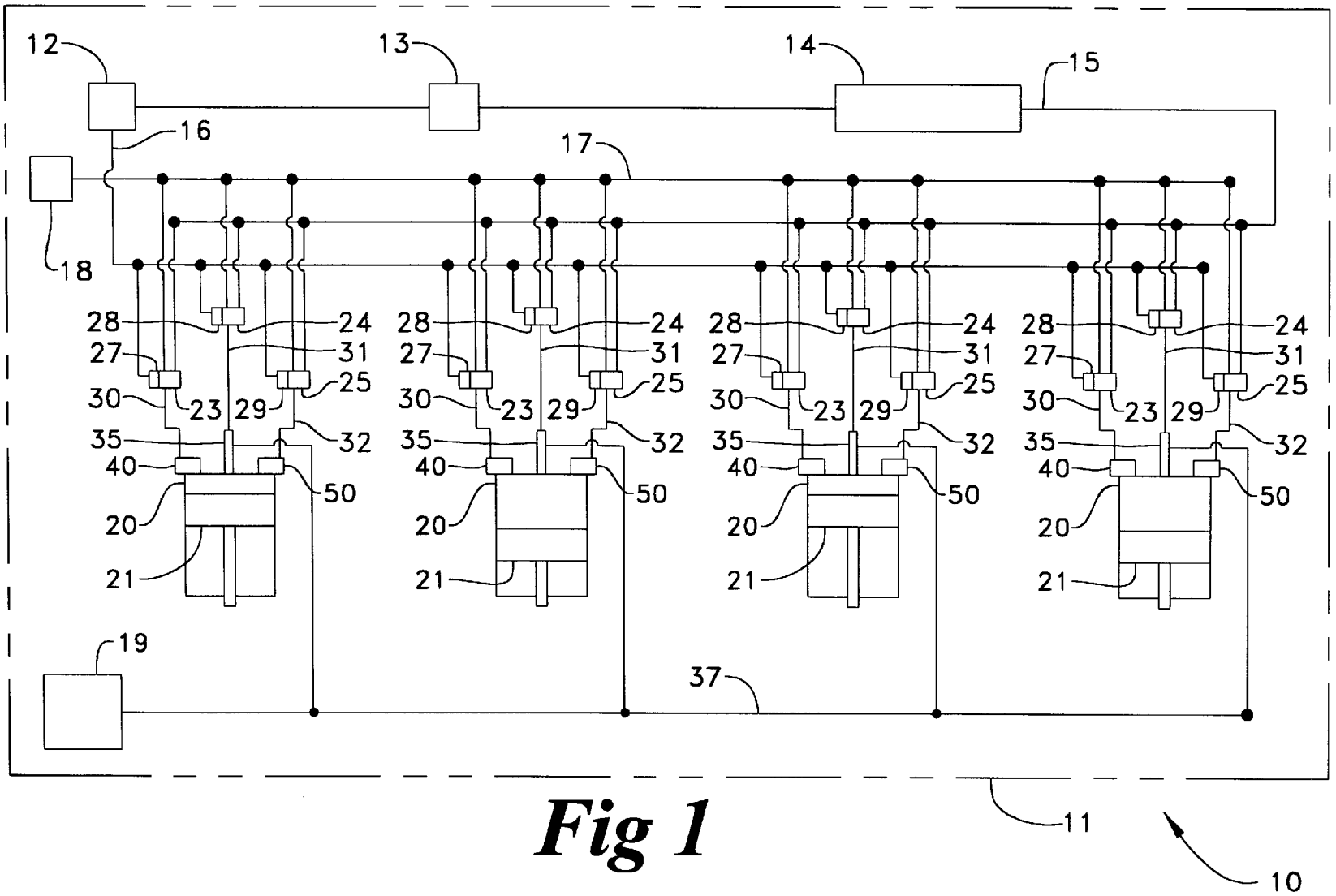
FIG. 1 is a diagrammatic representation of an engine according to the present invention.

Referring to FIG. 1 there is shown an engine 10 according to the present invention. A low pressure reservoir 12 is provided in engine 10 and preferably includes an amount of low pressure engine lubricating oil. While low pressure reservoir 12 is preferably an oil pan that contains engine lubricating oil, it should be appreciated that other fluid sources having an amount of available fluid, such as coolant, transmission fluid or fuel, could instead be used. A high pressure pump 13 pumps oil from low pressure reservoir 12 and delivers the same to high pressure manifold 14. High pressure oil flowing out of high pressure manifold 14 is delivered via high pressure fluid supply line 15 to a hydraulic system provided in engine 10, and oil is returned to low pressure reservoir 12 via low pressure return line 16 after it has performed work in the hydraulic system. Engine 10 also has an engine housing 11 that defines a plurality of cylinders 20.

Each of the cylinders 20 defined by engine housing 11 has a movable piston 21. Each piston 21 is movable between a retracted, downward position and an advanced, upward position. For a typical four cycle diesel engine 10, the advancing and retracting strokes of piston 21 correspond to the four stages of engine 10 operation. When piston 21 retracts from its top dead center position to its bottom dead center position for the first time, it is undergoing its intake stroke and air can be drawn into cylinder 20 via an intake valve 40. When piston 21 advances from its bottom dead center position to its top dead center position for the first time it is undergoing its compression stroke and air within cylinder 20 is compressed. At around the end of the compression stroke, fuel can be injected into cylinder 20 by fuel injector 35, and combustion within cylinder 20 can occur instantly, due to the high temperature of the compressed air.

This combustion drives piston 21 downward toward its bottom dead center position, for the power stroke of piston 21. Finally, when piston 21 once again advances from its bottom dead center position to its top dead center position, post combustion products remaining in cylinder 20 can be vented via an exhaust valve 50, corresponding to the exhaust stroke of piston 21. While engine 10 has been illustrated as a four cycle, four-cylinder engine, it should be appreciated that any desired number of cylinders could be defined by engine housing 11.

Each cylinder 20 is operably connected to a number of hydraulically actuated devices. As illustrated in FIG. 1, these hydraulic devices are preferably hydraulically actuated fuel injector 35 and two hydraulically actuated gas exchange valves, intake valve 40 and exhaust valve 50. Fuel injector 35 is fluidly connected to a fuel tank 19 via fuel line 37 and delivers fuel to cylinder 20 for combustion. Intake valve 40 delivers air to cylinder 20 for the combustion event, while exhaust valve 50 controls release of compressed air and other combustion residue from cylinder 20 at the end of an injection event. Fuel injection events generated by each fuel injector 35 are controlled by an electronic control valve 24 which selectively opens fuel injector 35 to high pressure manifold 14 and low pressure reservoir 12 via a hydraulic pressure supply line 31. Similarly, air intake events produced by intake valve 40 are controlled by electronic control valve 23, while exhaust events produced by exhaust valve 50 are controlled by electronic control valve 25. Intake valve 40 and exhaust valve 50 are alternately opened to high pressure manifold 14 and low pressure reservoir 12 via hydraulic pressure supply lines 30, 32, respectively.

Electronic control valves 23, 24, 25 are controlled in operation by an electronic control module 18 via communication line 17. Electronic control module 18 is capable of sending a current to an electric actuator 27, such as a solenoid or a piezoelectric actuator, to move electronic control valve 23 between a first position and a second position to control intake events. Likewise, electronic control module 18 is capable of sending a current to an actuator 28 to move electronic control valve 24 between a first position and a second position to control injection events and to an actuator 29 to move electronic control valve 25 between a first position and a second position to control exhaust events. For instance, when actuator 29 receives a current from electronic control module 18, electronic control valve 25 moves from a first position opening the hydraulic pressure supply line 32 to low pressure reservoir 12 to a second position opening hydraulic pressure supply line 32 to high pressure manifold 14. While electronic control valves 23, 24, 25 have been illustrated as being separated from the respective hydraulic devices which they control, it should be appreciated that they could instead be attached. It should further be appreciated that a single electronic control valve could replace any two, or even all three, electronic control valves 23, 24, 25 to control the hydraulic devices for each cylinder.

Figure 2:
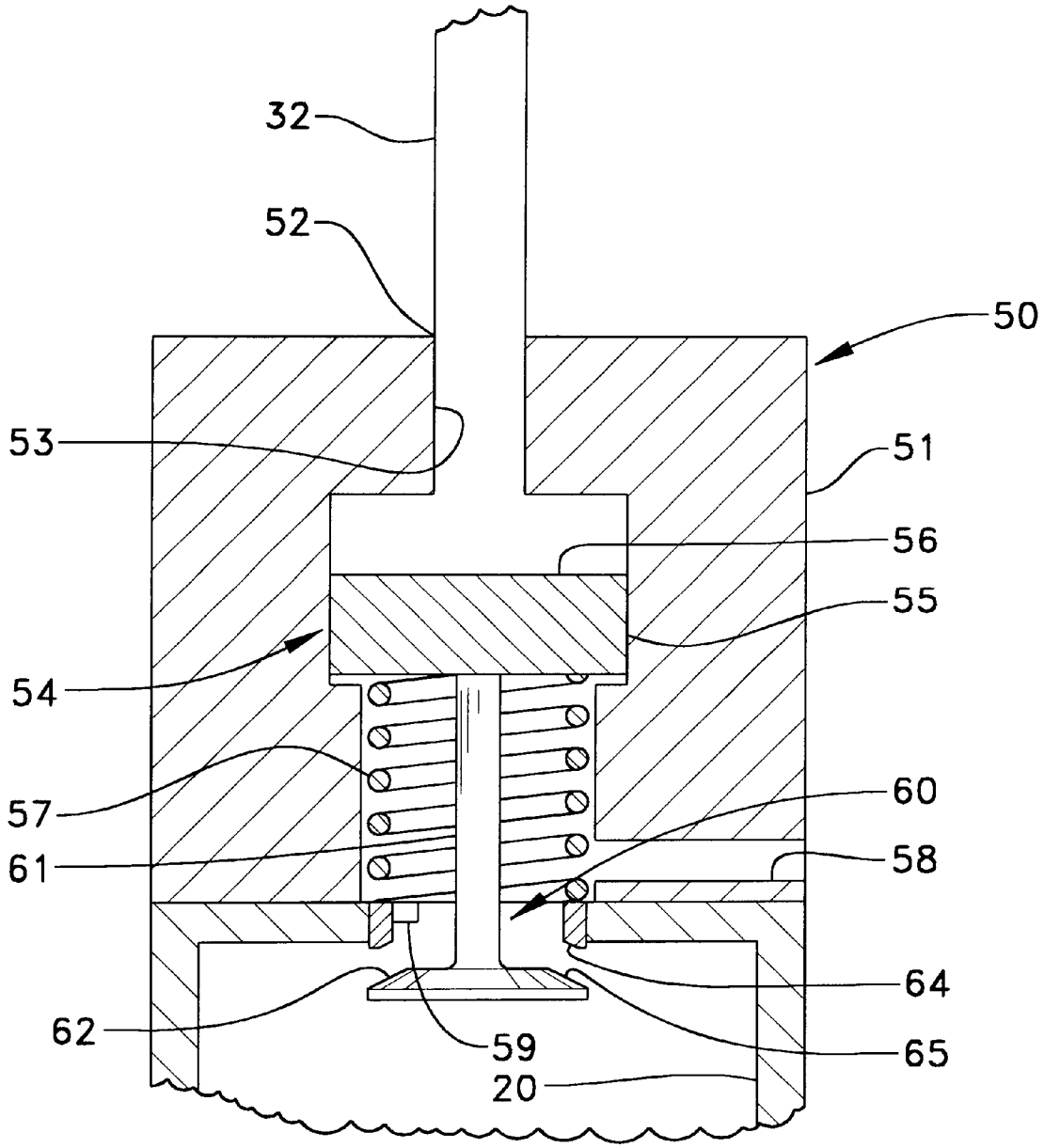
FIG. 2 is a diagrammatic representation of an exhaust valve according to the present invention.

Referring now to FIG. 2 there is shown exhaust valve 50 according to the present invention that includes a hydraulic valve actuator 54 and a valve member 60. Gas exchange valve 50 includes an exhaust valve body 51 that defines an actuation fluid passage 53 that is fluidly connected to hydraulic pressure supply line 32 via a hydraulic fluid inlet 52. A valve member 60 is movably positioned in exhaust valve body 51 and provides a stem portion 61 and a head portion 62. A piston portion 55 of hydraulic actuator 54 is operably coupled to valve member 60. Valve member 60 is movable between a closed position in which a valve surface 65 provided on stem portion 62 of valve member 60 is in contact with a valve seat 64 provided on valve body 51 and an open position in which valve surface 65 is away from contact with valve seat 64.

When valve member 60 is in its open position, the contents of cylinder 20, such as compressed air, can be vented via an exhaust passage 58 defined by valve body 51. However, when valve member 60 is in its closed position, cylinder 20 is blocked from exhaust passage 58 by the seating of valve surface 65 in valve seat 64. Valve member 60 is biased toward its closed position by a biasing spring 57. The relative strength of biasing spring 57 and the size of opening hydraulic surface 56 should be such that valve member 60 is moved toward its closed position when actuation fluid passage 53 is open to low pressure reservoir 12. Valve member 60 is moved toward its open position when actuation fluid passage 53 is open to high pressure manifold 14. While valve member 60 has been illustrated as being mechanically biased toward its closed position, it should be appreciated that it could alternatively be biased toward its closed position by hydraulic fluid acting on the bottom surface of piston portion 55 in opposition to the hydraulic forces which act on opening hydraulic surface 56.

As indicated, actuation fluid passage 53 is fluidly connected to hydraulic pressure supply line 32. Recall that hydraulic pressure supply line 32 is either open to high pressure manifold 14 or low pressure reservoir 12 depending upon the relative positioning of electronic control valve 25. Therefore, when electronic control valve 25 is in its second position, actuation fluid passage 53 is open to high pressure manifold 14 via hydraulic pressure supply line 32. Recall that electronic control valve 25 is moved to its second position when actuator 29 receives a current signal from electronic control module 18.

Returning to exhaust valve 50, recall that valve member 60 is returned to its closed position with valve surface 65 in contact with valve seat 64 under the action of biasing spring 57 when opening hydraulic surface 56 is exposed to low pressure in actuation fluid passage 53. The velocity at which valve member 60 impacts valve seat 64 can be quite high. It is known that higher impact velocities can fatigue stem portion 61 and wear out valve seat 64 and its surrounding area. This can lead to a reduction in the effective life of the exhaust valve 50, valve surface 65 and valve seat 64. Therefore, the present invention includes a method for slowing the movement of valve member 60 toward its closed position to reduce the impact velocity when valve surface 65 contacts valve seat 64.

In addition to the ability to produce a relatively long current signal, such as that used to move electronic control valve 25 to its second position, electronic control module 18 is also capable of sending a relatively short current signal to actuator 29. Depending upon the timing of this signal, the relatively short signal is sufficient to move electronic control valve 25 toward its second position. When electronic control valve 25 is moved briefly toward its second position, hydraulic pressure supply line 32 is briefly re-opened to high pressure manifold 14. This creates a hydraulic pulse that is sent through hydraulic pressure supply line 32 and actuation fluid passage 53 toward hydraulic surface 56 of piston portion 55. This hydraulic pulse is preferably of a sufficient magnitude to slow movement of valve surface 65 toward valve seat 64 when the pulse is directed toward hydraulic surface 56 as valve member 60 is approaching its closed position. However, this hydraulic pulse is preferably only of a sufficient magnitude to slow the movement of valve member 60, and is insufficient to reverse the movement direction of valve member 60. In other words, the hydraulic pulse is preferably insufficient to stop the movement of valve member 60 toward its closed position and begin moving it toward its open position. By slowing the movement of valve member 60 toward its closed position, the impact velocity of valve surface 65 as it contacts valve seat 64 can be reduced. It should be appreciated that the magnitude of the hydraulic pulse is determined by rail pressure in addition to the length of time that hydraulic pressure supply line 32 is open to high pressure manifold 14, as influence by the length of the current signal sent by electronic control module 18 to actuator 29.

Preferably, the hydraulic pulse is generated when valve member 60 is a predetermined distance from its closed position to ensure adequate impact velocity reduction. Therefore, a position sensor 59 could be provided. When utilized, position sensor 59 is preferably operatively coupled to valve member 60 in a manner that will allow it to detect the distance between valve surface 65 and valve seat 64. Position sensor 59 is preferably in communication with electronic control module 18 via communication line 17. Thus, when position sensor 59 detects that valve surface 65 is a predetermined distance from valve seat 64, this information can be signaled to electronic control module 18. Electronic control module 18 can then send a relatively short signal to actuator 29 to briefly move electronic control valve 25 toward its second position fluidly connecting hydraulic pressure supply line 32 with high pressure manifold 14 to create the hydraulic pulse. It should be appreciated that factors such as rail pressure and strength of biasing spring 57 contribute to the determination of the preferable predetermined distance at which the hydraulic pulse should be generated. In addition, the timing of the hydraulic pulse should include consideration of physical delays in the system electronics and hydraulics.

It should be appreciated that the actual distance between valve surface 65 and valve seat 64 as valve member 60 approaches its closed position could be determined by alternative methods. For instance, as an alternative to the closed loop method utilizing a position sensor, a preferable method for determining the timing of the hydraulic pulse might be an open loop method utilizing stored factory valve member movement data. Here, hydraulic pulse timing maps could be created wherein the pulse timing is mapped against such engine factors as engine speed and rail pressure. One method of creating these maps could include determining a reference timing point corresponding to the end of current to actuator 29 at the end of the exhaust event. In addition to this reference point, the time delay between the start of current from electronic control module 18 and the arrival of a hydraulic pulse on hydraulic surface 56 could be determined based upon such factors as mechanical and electrical system delays. From the reference data point and the time delay information, a current start time for movement of actuator 29 to produce a hydraulic pulse that will interact with valve member 60 when it is at the desired location between its open position and its closed position could be extrapolated. When extrapolated for various engine speeds and/or rail pressures, the timing maps for this preferable open loop strategy could be created. These maps could then be stored in a location accessible to electronic control module 18 for use in determining the appropriate time to send an electronic pulse to actuator 29, such that the hydraulic pulse will reach hydraulic surface 56 of valve member 60.

Industrial Applicability

Referring now to FIGS. 1 and 2, operation of the present invention will be discussed for use with exhaust valve 50. It should, however, be appreciated that the present invention is also suitable for use with intake valve 40. Prior to the intake stage for cylinder 20, electronic control valve 25 is in its first position such that hydraulic pressure supply line 32 is fluidly connected to low pressure reservoir 11. Low pressure is therefore acting on hydraulic surface 56, such that valve member 60 is in its closed position blocking cylinder 20 from fluid communication with exhaust passage 58. Prior to downward movement of piston 21 for the intake stroke, electronic control module 18 preferably sends a signal to actuator 27, which causes electronic control valve 23 to move to a position opening hydraulic pressure supply line 30 to high pressure rail 14. This causes a valve member within intake valve 40 to move to an open position, opening cylinder 20 to an air intake passage of intake valve 40. As piston 21 moves downward toward its bottom position it draws air into cylinder 21 via intake valve 40. At about piston bottom dead center position, the intake stroke is complete, current to actuator 27 is ended and electronic control valve 23 returns to its position opening hydraulic pressure supply line 30 to low pressure reservoir 12. The intake valve member now moves toward its closed position under the action of a return spring to block cylinder 20 from the air intake passage of intake valve 40. Shortly before the intake valve member impacts its seat, a hydraulic pulse is sent to slow its movement and reduce the impact velocity. At about the same time, piston 21 begins to advance toward its upward position to compress the air that has been drawn into cylinder 20.

Preferably, during the compression stroke of piston 21, electronic control module 18 has signaled actuator 28 to move electronic control valve 24 to begin the injection event of fuel injector 35. The injection event is preferably timed such that fuel injection will occur as piston 21 is near its top dead center position. When fuel is injected into cylinder 20, it ignites instantly due to the high temperature of the compressed air within cylinder 20. This combustion drives piston 21 downward for its power stroke. Once the desired amount of fuel has been injected into cylinder 20, actuator 28 is signaled to end the injection event. The various components of fuel injector 35 then reset themselves in preparation for the next injection event. As the components of fuel injector 35 are resetting themselves, piston 21 is advancing toward its top dead center position for its exhaust stroke to vent any residue from injection out of cylinder 20 via the exhaust valve.

Figure 3A:
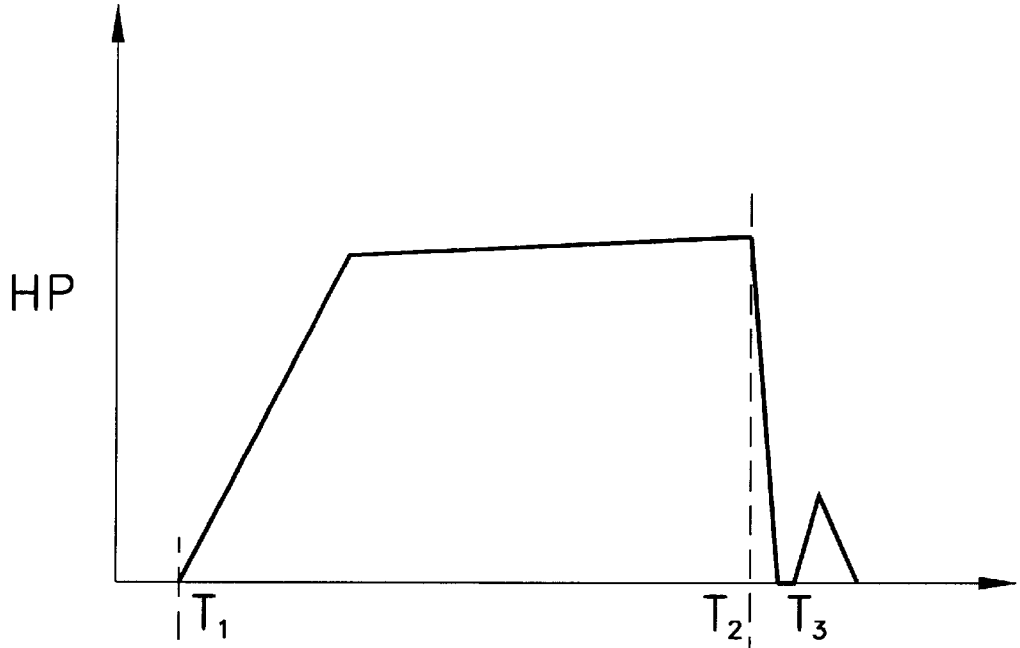
FIGS. 3*a–b* show hydraulic pressure (HP) exerted on a hydraulic surface of a gas exchange valve member and gas exchange valve member position (P), respectively, graphed versus time (T) according to the present invention.
Figure 3B:
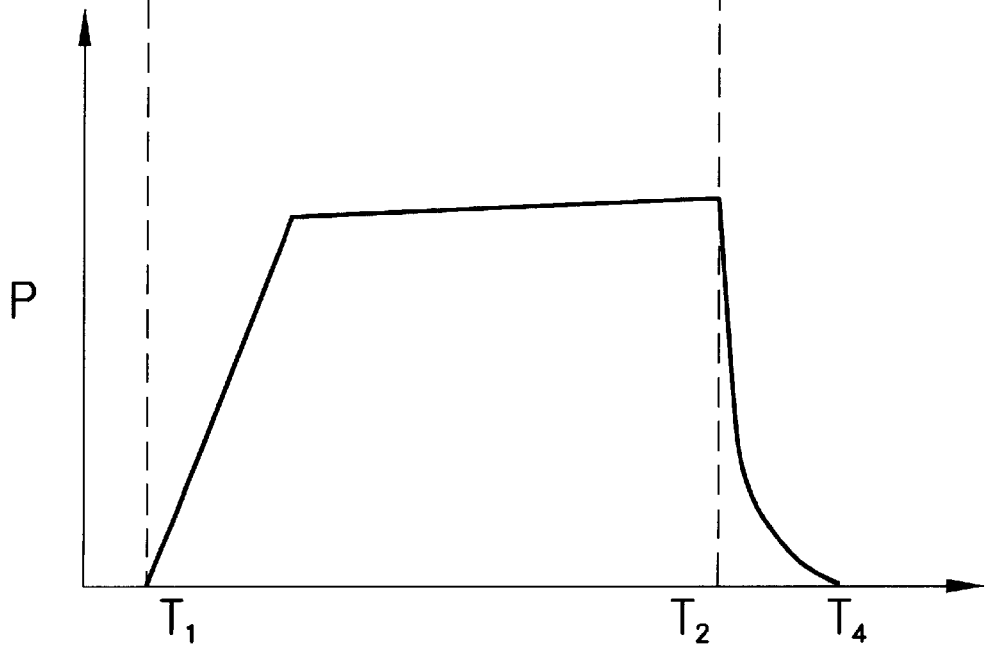

During a typical engine cycle, once piston 21 reaches the bottom dead center position for its power stroke, it begins to advance again for the exhaust stroke of the cylinder cycle. Current to actuator 29 is preferably initiated and electronic control valve 25 is moved to a position opening hydraulic pressure supply line 32 to high pressure manifold 14. Referring in addition to FIG. 3, hydraulic pressure acting on hydraulic surface 56 is increased ($T_1$, FIG. 3*a*), resulting in movement of valve member 60 toward its open position ($T_1$, FIG. 3*b*). This is preferably timed such that valve member 60 is moved to its open position at the beginning of the advance of piston 21. In other words, exhaust valve 50 is preferably opened for most of the duration of the movement of piston 21 from its bottom dead center position to its top dead center position, and post combustion products remaining in cylinder 20 can be vented. Once the combustion products have been vented from cylinder 20, current to actuator 29 is ended and electronic control valve 25 can return to its first position to open hydraulic pressure supply line 32 to low pressure reservoir 12, exposing hydraulic surface 56 to low pressure ($T_2$, FIG. 3*a*) and allowing valve member 60 to move toward its retracted position under the action of biasing spring 57 ($T_2$, FIG. 3*b*).

As valve member 60 is returning to its closed position, position sensor 59 preferably monitors the distance between valve surface 65 and valve seat 64. When valve surface 65 is a predetermined distance from valve seat 64, position sensor 59 signals electronic control module 18 to send a relatively short current to actuator 29 to briefly move electronic control valve 25 toward its second position opening hydraulic pressure supply line 32 briefly to high pressure manifold 14. This quick movement of electronic control valve 25 creates a hydraulic pulse within hydraulic pressure supply line 32 that is directed toward hydraulic surface 56 ($T_3$, FIG. 3*a*). This hydraulic pulse acts against hydraulic surface 56 to slow the movement of valve member 60 toward its closed position. Valve member 60 continues to move toward its closed position when valve surface 65 contacts valve seat 64 ($T_4$, FIG. 3*b*). However, valve surface 65 contacts valve seat 64 at a reduced impact velocity in response to the hydraulic pulse that acted on hydraulic surface 56.

The present invention utilizes a hydraulic pulse to reduce the impact velocity of valve member 60 as it reaches its closed position. This can lead to a reduction in valve stem fatigue caused by valve closing, as well as a reduction in the wear on the valve seat area. In turn, this can lead to an increase in the effective life of the gas exchange valve member and its respective valve seating surface. It should be appreciated that this strategy does not significantly lengthen the duration of the movement of the valve member from its closed position to its open position. Instead, the duration of the valve closing is only minimally lengthened because only a small portion of the closing is effected by the hydraulic pulse, rather than the entire valve closing event. It should further be appreciated that the present invention could be utilized to reduce the impact velocity of hybrid valves. For instance, in those valves that are cam actuated but include a hydraulic interaction to perform a specific function, such as exhaust braking, the present invention could be utilized in response to the greater impact velocities due to the hydraulic interaction.

It should be understood that the above description is intended for illustrative purposes only, and is not intended to limit the scope of the present invention in any way. For instance, while the present invention has been described for use in slowing a valve member that is approaching a closed position, it should be appreciated that it could also be used to slow valve members moving toward their open positions, especially in those instances when the valve member contacts a surface as it reaches its open position. Further, while a position sensor has been illustrated for use in determining the location of the valve member between its open position and its closed position, it should be appreciated that other methods, such as use of stored factory valve member movement data could instead be used for determining timing of the hydraulic pulse. Thus, those skilled in the art will appreciate that other aspects, objects and advantages of this invention can be obtained from a study of the drawings, the disclosure and the appended claims.

What is claimed is:

1. A hydraulically actuated valve including a valve member operably coupled to a hydraulic valve actuator, the improvement comprising:

said valve member being hydraulically moveable by said hydraulic valve actuator from a second position, which is a closed position, to a first position, which is an open position; and a hydraulic pulse generator fluidly connected to said hydraulic valve actuator and being capable of directing a hydraulic pulse toward said hydraulic valve actuator as said valve member moves from said first position toward said second position, and said hydraulic pulse having a duration shorter than a time taken to move said valve member from said first position to said second position.

2. The hydraulically actuated valve of claim 1 wherein said valve is a gas exchange valve.

3. The hydraulically actuated valve of claim 1 wherein said valve member is mechanically biased toward said second position.

4. The hydraulically actuated valve of claim 1 wherein said hydraulic valve actuator includes a piston portion including an opening hydraulic surface; and said hydraulic pulse is directed toward said opening hydraulic surface.

5. The hydraulically actuated valve of claim 1 including a valve position sensor operably positioned to detect a position of said valve member.

6. The hydraulically actuated valve of claim 1 wherein said hydraulic pulse generator includes an electronic control valve.

7. The hydraulically actuated valve of claim 1 wherein a magnitude of said hydraulic pulse is sufficient to decelerate movement of said valve member toward said second position but insufficient to move said valve member toward said first position.

8. An electronic control module comprising:

a means for determining when a valve member of a hydraulically actuated valve is at a predetermined location between a first position which is an open position, and a second position which is a closed position; and a means for directing a hydraulic pulse toward said hydraulically actuated valve when said valve member is approaching said second position, wherein a magnitude of said hydraulic pulse is insufficient to reverse a movement direction of said valve member and said hydraulic pulse having a duration shorter that a time taken to move said valve member from said first position to said second position.

9. The electronic control module of claim 8 wherein said means determining includes a valve position sensor input.

10. The electronic control module of claim 8 wherein said means for determining includes valve member movement timing data stored in a location accessible to said electronic control module.

11. The electronic control module of claim 8 wherein said means for directing a hydraulic pulse includes a means for commanding actuation of an electronic control valve positioned between said hydraulically actuated valve and a source of high pressure.

12. A method of controlling a hydraulically controlled valve comprising:

providing a hydraulically controlled valve including a valve member movably positioned in a valve body, wherein said valve member is movable between a first position and a second position and includes a hydraulic surface; and slowing movement of said valve member when moving toward said second position, at least in part by directing a hydraulic pulse toward said valve member when said valve member is approaching said second position, and said hydraulic pulse having a duration shorter than a time taken to move said valve member from said first position to said second position.

13. The method of claim 12 wherein said slowing step includes a step of determining a location of said valve member when moving toward said second position.

14. The method of claim 13 wherein said determining step includes the step of positioning a valve position sensor in a location operable to sense a position of said valve member.

15. The method of claim 13 wherein said determining step includes the step of determining said location includes a step of accessing valve member movement timing data.

16. The method of claim 12 wherein said hydraulic surface is exposed to fluid pressure in an actuation fluid passage defined by said valve body; and said step of slowing said valve member includes the step of signaling an electronic control valve to briefly open said actuation fluid passage to a source of high pressure.

17. The method of claim 12 including a step of mechanically biasing said valve member toward said second position.

* * * * *

UNITED STATES PATENT AND TRADEMARK OFFICE

CERTIFICATE OF CORRECTION

PATENT NO. : 6,474,620 B2
DATED : November 5, 2002
INVENTOR(S) : Sean O. Cornell et al.

It is certified that error appears in the above-identified patent and that said Letters Patent is hereby corrected as shown below:

Column 8,
After line 62, ending in "surface; and" insert new paragraph:
-- hydraulically moving said valve member from said second position, which is a closed position, to said first position, which is an open position; and --.

Signed and Sealed this

Eighteenth Day of March, 2003

JAMES E. ROGAN
*Director of the United States Patent and Trademark Office*